US010780309B2

(12) United States Patent
Garcia et al.

(10) Patent No.: US 10,780,309 B2
(45) Date of Patent: Sep. 22, 2020

(54) BARBELL

(71) Applicant: Coulter Ventures, LLC, Columbus, OH (US)

(72) Inventors: Nicolas L. Garcia, Centerburg, OH (US); Anahita H. Ameri, Columbus, OH (US)

(73) Assignee: Coulter Ventures, LLC, Columbus, OH (US)

( * ) Notice: Subject to any disclaimer, the term of this patent is extended or adjusted under 35 U.S.C. 154(b) by 0 days.

(21) Appl. No.: 15/873,048

(22) Filed: Jan. 17, 2018

(65) Prior Publication Data

US 2019/0217147 A1 Jul. 18, 2019

(51) Int. Cl.

| | |
|---|---|
| ***A63B 21/072*** | (2006.01) |
| ***A63B 1/00*** | (2006.01) |
| ***A63B 21/078*** | (2006.01) |

(52) U.S. Cl.

CPC ..... *A63B 21/0724* (2013.01); *A63B 1/00* (2013.01); *A63B 21/0783* (2015.10)

(58) Field of Classification Search

CPC ..... A63B 21/0724; A63B 21/0783; A63B 21/0004; A63B 21/072; A63B 21/0728; A63B 21/0722; A63B 21/0726; A63B 2244/09

See application file for complete search history.

(56) References Cited

U.S. PATENT DOCUMENTS 4,455,020 A * 6/1984 Schnell ..... A63B 21/0728 482/106
5,628,716 A * 5/1997 Brice ..... A63B 21/0728 482/106
5,826,453 A * 10/1998 Prevey, III ..... B23P 9/02 72/75

(Continued)

OTHER PUBLICATIONS

Rogue Fitness, "Rogue Euro 28MM Olympic WL Bar," Nov. 30, 2016 [retrieved on May 9, 2019], 14 pages. Retrieved from the Internet: <http://www.roguefitness.com/euro-28mm-olympic-wl-bar> (Year: 2016).*

(Continued)

*Primary Examiner* — Loan B Jimenez
*Assistant Examiner* — Kathleen Vermillera
(74) *Attorney, Agent, or Firm* — The Watson IP Group, PLC; Jovan N. Jovanovic

(57) ABSTRACT

A barbell comprising a bar member, a first side weight assembly and a second side weight assembly. The bar member has a first side sleeve region and a second side sleeve region opposite the first side sleeve region. The first side weight assembly includes a weight surface and extends over the first side sleeve region, and is rotatively coupled to the bar member through an inner and outer slidable engagement surface. The second side weight assembly includes a weight surface and extends over the second side sleeve region, and is rotatively coupled to the bar member through an inner and outer slidable engagement surface. The bar (Continued)

member includes a first and second surface enhanced region, the first surface enhanced region spanning a portion of the central region and the first side sleeve region, and with the second surface enhanced region spanning a portion of the central region and the second side sleeve region.

21 Claims, 9 Drawing Sheets

(56) References Cited

U.S. PATENT DOCUMENTS

| | | | | |
|---|---|---|---|---|
| 9,314,661 | B1 * | 4/2016 | Chen | A63B 21/0724 |
| 2014/0274595 | A1 * | 9/2014 | Patti | A63B 21/4049 482/106 |
| 2015/0038302 | A1 * | 2/2015 | O'Brien | A63B 21/0724 482/107 |

OTHER PUBLICATIONS

Rogue Fitness, "The Ohio Bar—Stainless Steel," Nov. 26, 2016 [retrieved on May 9, 2019], 10 pages. Retrieved from the Internet: <http://www.roguefitness.com/stainless-steel-ohio-bar> (Year: 2016).*

Lambda Technologies, "Low Plasticity Burnishing (LBP)," Mar. 4, 2016 [retrieved on May 13, 2019], 3 pages. Retrieved from the Internet: <http://www.lambdatechs.com/low-plasticity-burnishing-LPB.html> (Year: 2016).*

* cited by examiner

BARBELL

CROSS-REFERENCE TO RELATED APPLICATION

N/A

BACKGROUND OF THE DISCLOSURE

1. Field of the Disclosure

The disclosure relates in general to barbells, and more particularly, to a barbell that is configured for repeated dropping without failure, as well as to a barbell having improved durability.

2. Background Art

In the past, typical barbells were utilized for power lifting, Olympic lifting and/or slow lifts in a typical gym. One of the heaviest users of barbells were Olympic weightlifting training centers. Based upon data review from different Olympic weightlifting facilities, it has been determined that a typical barbell in such a facility was dropped on the order of 10,000 to 20,000 times per year.

With the advent of higher repetition facilities and workouts (including, but not limited to Crossfit®), it has been determined that barbells in such facilities are dropped in excess of 150,000 times per year. That is roughly an eight-fold to fifteen-fold increase in the number of drop cycles experienced by a barbell.

Problematically, with the increase in drop cycles, complete failure of barbells has been observed at an unexpectedly high rate. Generally, such failure is the result of fatigue fracture of the bar member.

SUMMARY OF THE DISCLOSURE

The disclosure is directed in one aspect to a barbell comprising a bar member, a first side weight assembly and a second side weight assembly. The bar member has a first end and a second end opposite the first end, and defines a central region, a first side sleeve region to one side of the central region and a second side sleeve region on a side opposite the first side sleeve region. The first side weight assembly includes a first sleeve member, an inner slidable engagement structure and an outer slidable engagement structure. The first sleeve member has an inner end and an outer end, and has a weight surface and an inner bore. The first sleeve region of the bar member extends into the inner bore of the first sleeve member. The inner slidable engagement structure is positioned within the inner bore between the first sleeve member and the bar member proximate the inner end, to, in turn, facilitate rotation of the first sleeve member about the bar member. The outer slidable engagement structure is positioned within the inner bore between the first sleeve member and the bar member proximate the outer end, to, in turn, facilitate rotation of the first sleeve member about the bar member.

The second side weight assembly likewise includes a second sleeve member, an inner slidable engagement structure and an outer slidable engagement structure. The second sleeve member has an inner end and an outer end, and has a weight surface and an inner bore. The second sleeve region of the bar member extends into the inner bore of the second sleeve member. The inner slidable engagement structure is positioned within the inner bore between the second sleeve member and the bar member proximate the inner end, to, in turn, facilitate rotation of the second sleeve member about the bar member. The outer slidable engagement structure is positioned within the inner bore between the second sleeve member and the bar member proximate the outer end, to, in turn, facilitate rotation of the second sleeve member about the bar member.

At least a portion of the bar member includes a first surface enhanced region extending from the first side sleeve region so as to be at least partially engageable by the inner slidable engagement structure and extending beyond the inner end of the first sleeve member into the central region. Additionally, a second surface enhanced region extends from the second side sleeve region so as to be at least partially engageable by the inner slidable engagement structure and extending beyond the inner end of the second sleeve member into the central region.

In some configurations, the first and second surface enhanced regions each have compressive residual stress that extends axially inwardly from the outer surface.

In some configurations, the first and second surface enhanced regions include a compressive residual stress at least 0.01 inches inwardly from the outer surface.

In some configurations, the first and second surface enhanced regions include a compressive residual stress at least 0.025 inches inwardly from the outer surface.

In some configurations, the first and second surface enhanced regions include a compressive residual stress at least 0.035 inches inwardly from the outer surface.

In some configurations, the compressive residual stress at the outer surface of each of the first and second enhanced regions is at least −50 ksi.

In some configurations, the compressive residual stress at the outer surface of each of the first and second enhanced regions is at least approximately −100 ksi.

In some configurations, each of the first and second work hardened surfaces have a length of at least 1.75 inches and extend about an entire circumference of the bar member along the outer surface thereof.

In some configurations, a cold working percentage of the first and second surface enhanced regions is less than approximately 3.5%.

In some configurations, the inner slidable engagement structure and the outer slidable engagement structure comprises one of a bushing and a bearing.

In some configurations, the bushing comprises a bronze bushing and the bearing comprises a needle bearing.

In some configurations, the first sleeve member further comprises a shoulder portion at an inner end of the first sleeve member, with the weight surface extending outwardly therefrom to the outer end of the first sleeve member. The second sleeve member further comprises a shoulder portion at an inner end of the second sleeve member, with the weight surface extending outwardly therefrom to the outer end of the second sleeve member. At least a portion of the weight surface, and the entirety of the shoulder portion of the first sleeve member overlie the first surface enhanced region. At least a portion of the weight surface, and the entirety of the shoulder portion of the second sleeve member overlie the second surface enhanced region.

In some configurations, the bar member includes a cross-sectional configuration that is circular, and has a diameter of between 22 mm and 36 mm.

In some configurations, the first side weight assembly and the second side weight assembly are substantially mirror images of each other taken about an axis bisecting the bar member.

In some configurations, the barbell has an F scale of at least F6.

In some configurations, the barbell has an F scale of at least F20.

In another aspect of the disclosure, the disclosure is directed to a bar member that is structurally configured for a barbell. The bar member includes an outer surface a first end and a second end. The central region has a first side sleeve region to a first side of the central region and a second side sleeve region to a second side of the central region. A portion of the first side sleeve region defines an inner bearing region, and a portion of the second side sleeve region defines an inner bearing region. A portion of the outer surface extends between at least a portion of the inner bearing region and a central region of the first side sleeve region defining a first surface enhanced region. A portion of the outer surface extends between at least a portion of the inner bearing region and the central region of the second side sleeve region defining a second surface enhanced region.

In some configurations, a portion of the central region includes knurling, with each of the first surface enhanced region and the second surface enhanced region extending into the knurling.

In some configurations, the bar member comprises a circular cross-sectional configuration, having a diameter of between 22 mm and 36 mm.

In some configurations, the first surface enhanced region and the second surface enhanced region are spaced apart from each other.

In some configurations, the first side sleeve region includes an outer bearing region which is spaced apart from the first surface enhanced region and the second side sleeve region includes an outer bearing region which is spaced apart from the second surface enhanced region.

In some configurations, the bar member comprises one of a stainless steel and a steel member having a tensile strength of between 185,000 and 220,000 psi.

BRIEF DESCRIPTION OF THE DRAWINGS

The disclosure will now be described with reference to the drawings wherein.

DETAILED DESCRIPTION OF THE DISCLOSURE

Figure 1:
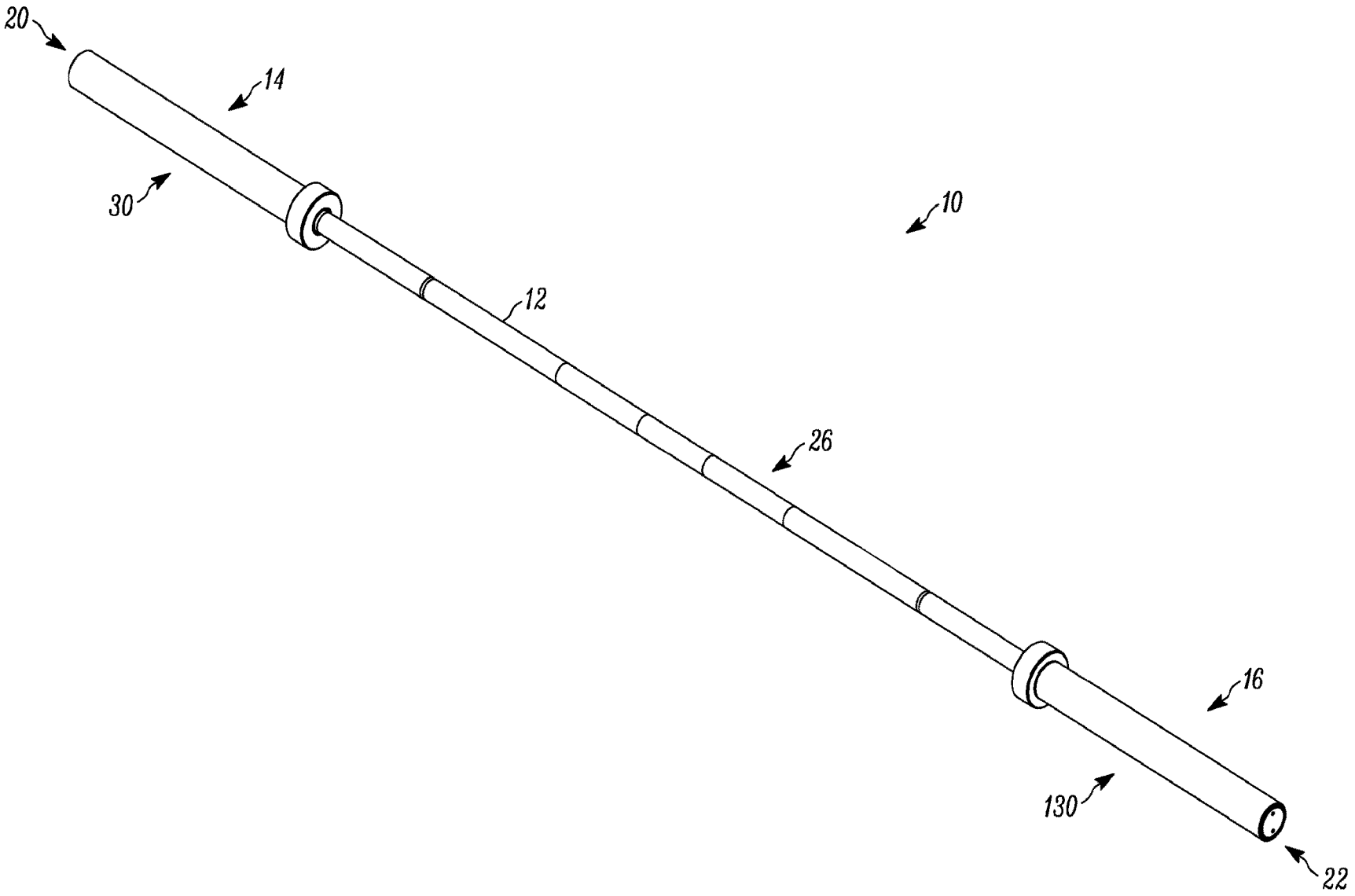
FIG. 1 of the drawings is a perspective view of the barbell of the present disclosure.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 2:
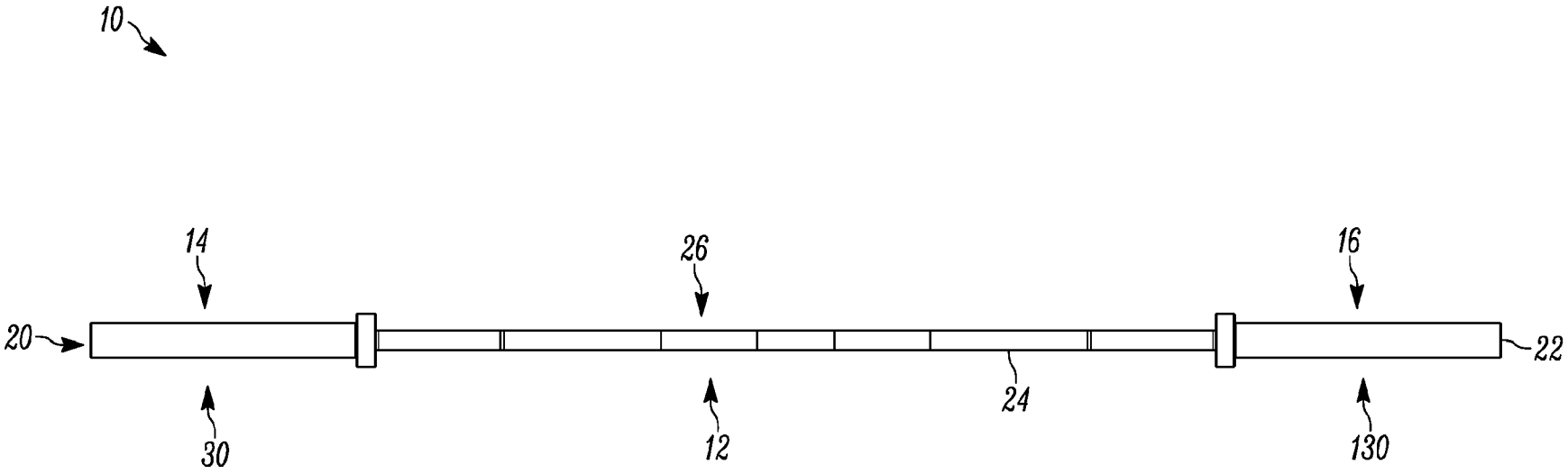
FIG. 2 of the drawings is a front elevational view of the barbell of the present disclosure.
Figure 3:
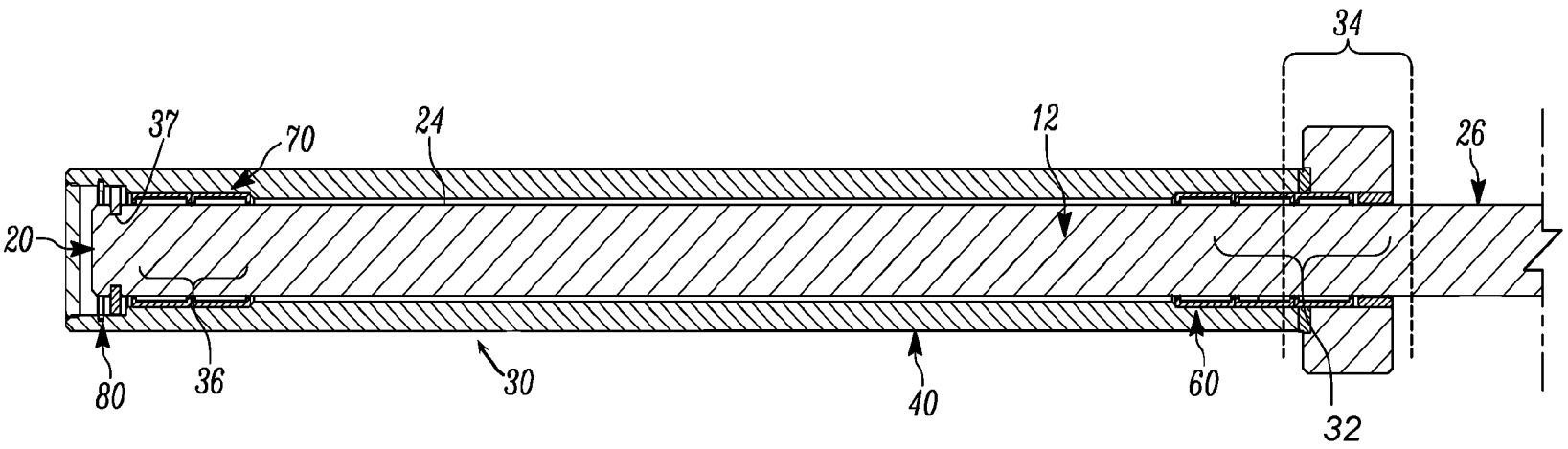
FIG. 3 of the drawings is a partial cross-sectional view of the barbell of the present disclosure, showing, in particular, the first side weight assembly and the bar member, as well as the interface therebetween, which comprises needle bearings.
Figure 4:
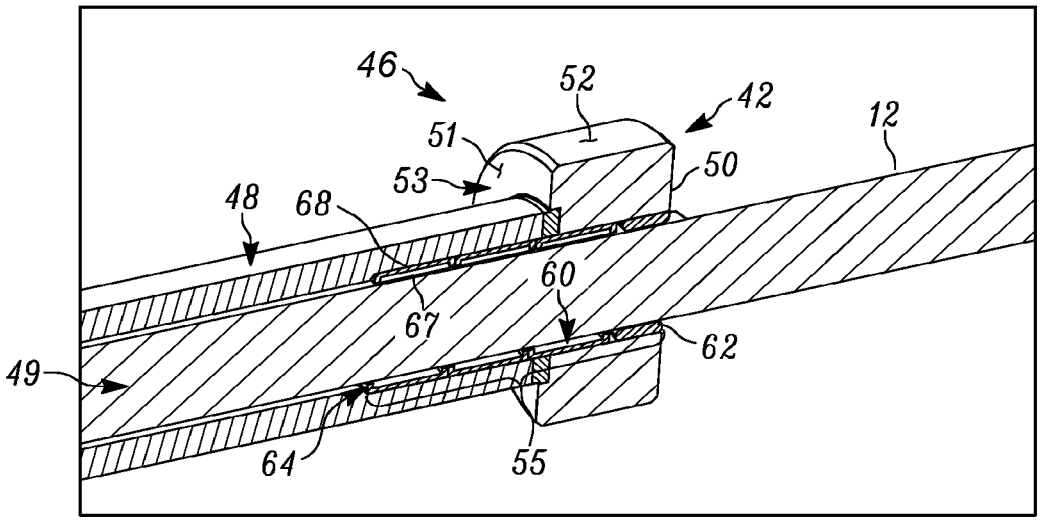
FIG. 4 of the drawings is a partial cross-sectional view of the barbell of the present disclosure, showing, in particular, the inner slidable engagement structure interfacing with each of the first sleeve member and the bar member.

Referring now to the drawings and in particular to FIGS. 1 and 2, the barbell is shown generally at 10. The barbell 10 includes bar member 12, first side weight assembly 14 and second side weight assembly 16. The barbell is typically loaded with weights on either end, and then a user can perform different exercises. The weights that are positioned on either end generally are shown at 300 in FIGS. 7 and 8 and often referred to as plates. The different plates generally have an inner surface, an outer surface, an outer perimeter and a central opening. The outer perimeter is typically one of round and polygonal, although other configurations are contemplated. Generally, the inner and outer surface include planar elements and generally define planar surfaces with a topography that includes reliefs and/or indentations and/or openings. Typically, the topography includes structures that either one of aid the grasping of the plate as well as identifying indicia that may include manufacturer and the mass or weight of the plate. Such plates come in a number of different configurations, and are often made of metal which may be coated or coupled to elastomeric or polymeric materials (i.e. bumper plates). These plates come in a variety of sizes from 100 lb down to fractional weights. In the United States, the most common weights are 45 lb, 35 lb, 25 lb, 10 lb, 5 lb, 2.5 lb and 1.25 lb. The barbell is not limited to use in association with any particular type of weight or plate. A barbell having a weight at each end thereof is shown schematically in FIGS. 7 and 8. In many configurations, the barbell preferably has a weight of 15 kg or 20 kg.

With reference to FIGS. 1 and 2, the bar member 12 includes first end 20, second end 22 and outer surface 24. The bar member is further divided into a first side sleeve region 30, a second side sleeve region 130 and a central region 26. The bar member generally has a substantially uniform diameter for the central region 26, and may include knurling or other roughened or grip enhancing configurations. While in the configuration shown, the central region is substantially uniform and substantially linear, thereby resembling a standard bar or an Olympic bar, the disclosure is not limited to such bars. Of course, other configurations of the central region, including but not limited to such structures that define a trap bar, a safety squat bar, a cambered bar, a swiss bar, a multi grip bar, a curl bar, among others, are likewise contemplated. The configuration and shape of the central region is therefore illustrative, and is not to be deemed limiting. A typical barbell, such as an Olympic barbell may be on the order of 65 inches to 95 inches long (or longer or shorter) with a diameter of between 22 and 36 mm, and often 25, 27 28, 28.5 or 29 mm in diameter. Of course, this is exemplary, and not to be deemed limiting.

With reference to FIGS. 3 through 6, the first side sleeve region 30 is positioned at the first end 20 and includes inner bearing region 32, first surface enhanced region 34, and outer bearing region 36. An annular channel 37 is disposed just inboard of the outer end of the first side sleeve region. It will be understood that the second side sleeve region is substantially identical to the first side sleeve region, and, generally a mirror image taken about an axis that bisects or otherwise intersects the bar member. As such one side will be described with the understanding that the other side is substantially identical in structural configuration (while particular variations may be presented between the sides). The bar member is typically formed from a steel member, or a number of steel components that are welded together (in the case of specialty bars). Other materials, such as, for example, stainless steel, other metals and alloys thereof, and composites are contemplated for use. It is also contemplated that the barbell may have a chrome finish or a zinc finish, for example.

The first side weight assembly 14 is shown in FIGS. 3 through 6, as comprising first sleeve member 40, inner slidable engagement structure 60, outer slidable engagement structure 70 and coupling assembly 80. The first side weight assembly 14 is substantially identical to the second side weight assembly 16. As such, the first side weight assembly 14 will be described in great detail with the understanding that the second side weight assembly 16 is substantially identical. As with the second side sleeve region, the second side weight assembly 16 and the components thereof will be identified with the same reference numbers as the first side weight assembly 14 augmented by 100.

The first sleeve member 40 includes inner end 42, outer end 44, shoulder portion 46, weight surface 48 and inner bore 49. The outer end 44 generally corresponds to the first end 20 of the bar member, although they may be spaced apart from each other to some extent. The inner end 42 is proximal to the central region 26 of the bar member, being generally opposite of the outer end 44. The shoulder portion 46 comprises inner surface 50, weight surface 51, and radial surface 52. The radial surface 52 extends between the inner surface 50 and the weight surface 51 of the shoulder portion 46, with the inner surface 50 and weight surface 51 generally opposite one another with the inner surface 50 facing the central region 26. The shoulder portion 46 is positioned about the inner end 42 of the first sleeve member 40.

The weight surface 48 comprises proximal end 53 and distal end 54, with the distal end 54 generally corresponding to the outer end 44 of the first sleeve member 40 and the proximal end 53 generally corresponding to the weight surface 51 of the shoulder portion 46. It will be understood that the weight surface 48 is configured to receive a plurality of weights positioned therearound, with the shoulder portion limiting further inward movement thereof.

In some configurations, such as an Olympic barbell, the weight surface may be 50 mm in diameter, with a length of 415 mm. The shoulder portion may have a thickness of 10-70 mm with a diameter of 60-100 mm. Of course, other dimensions are contemplated, and these are merely exemplary. For example, the weight surface may be shorter, or longer depending on the application.

The inner bore 49 comprises a bore inner bearing region 55, a bore outer bearing region 56, annular slot 57, coupling assembly region 58, and annular stop wall 59. The bore inner bearing region 55 is proximal the central region 26 and generally opposite the outer bearing region 56, proximal to the outer end 44. The coupling assembly region 58 is generally outboard of the bore outer bearing region 56. The annular slot 57 and annular stop wall 59 are both similarly proximate to the bore outer bearing region 56 of the inner bore 49. It will be understood that these structures interface with the coupling assembly to releasably retain the first sleeve member, as well as the inner and outer slidable engagement structures in position relative to the bar member.

The inner slidable engagement structure 60 comprises proximal end 62, distal end 64, inner surface 67, and outer surface 68. The proximal end 62 is generally aligned with the inner end 42 of the first sleeve member 40 with the distal end 64 generally opposite. The inner surface 67 and outer surface 68 extend the distance between the proximal end 62 and distal end 64 of the inner slidable engagement structure, with the inner surface and the outer surface generally opposite about the inner slidable engagement structure 60 but concentric in relation to one another. The outer slidable engagement structure 70 comprises proximal end 72, distal end 74, inner surface 76, and outer surface 78. The distal end 74 is proximal to the outer end 44 of the first sleeve member 40 with the proximal end 72 generally opposite. The inner surface 76 and outer surface 78 extend the distance between the proximal end 72 and distal end 74 of the outer slidable engagement structure, with the inner surface and the outer surface generally opposite about the outer slidable engagement structure 70, but concentric in relation to one another. The inner bore 49 has its size and dimensions defined by the first sleeve member 40 or, in more detail, is the void of material within the sleeve member.

Figure 5:
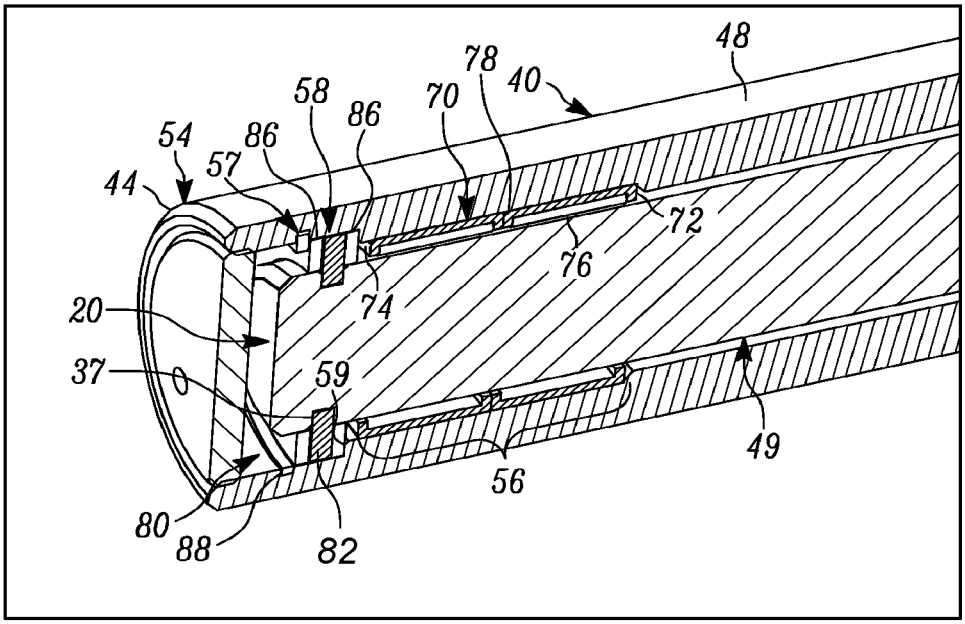
FIG. 5 of the drawings is a partial cross-sectional view of the barbell of the present disclosure, showing, in particular, the outer slidable engagement structure interfacing with each of the first sleeve member and the bar member.
Figure 6:
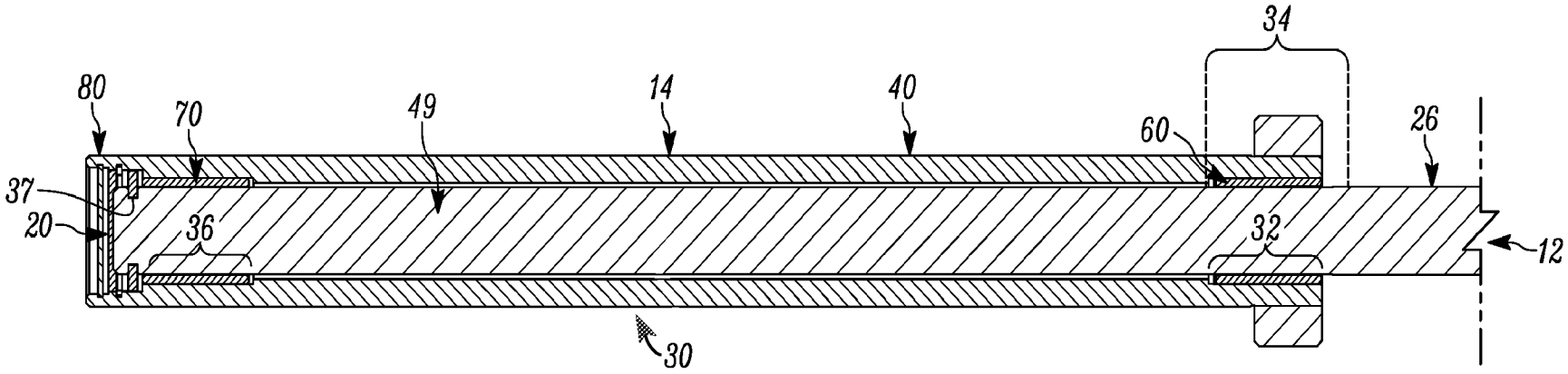
FIG. 6 of the drawings is a partial cross-sectional view of another configuration of the barbell of the present disclosure, showing, in particular, the first side weight assembly and the bar member, as well as the interface therebetween which comprises bushings.

In the configuration shown in FIG. 6, the inner slidable engagement structure and the outer slidable engagement structure each comprise a bronze bushing. Such a bushing is of relatively low friction, and, as such, the inner slidable engagement structure allows for rotative movement of the first sleeve member relative to the bar member, in a relatively low friction environment. In the configuration shown in FIGS. 1 through 5, the inner slidable engagement structure and the outer slidable engagement structure each comprise needle bearings, which, while not required, tend to be of lower friction than the bronze bushings. Of course, the inner and outer slidable engagement structures may comprise other types of bushings and/or bearings, such as polymer bushings, roller, or ball bearings, or the like, as well as combinations thereof. That is, the inner and outer slidable engagement structure may comprise different types of structures, i.e., one may be a bearing of one type, and the other may be a bushing of one type. These are merely exemplary and are not to be deemed limiting.

Referring now to FIG. 5, coupling assembly 80 comprises at least one retention ring 82, washers 86, and spring ring 88. The rings 82/88 are arranged coaxially in relation to one another, within the outer end 44 of the first sleeve member 40. The rings of the coupling assembly 80 are positioned within the annular channel 37 such that the bar is fixed from slidable movement by the contact between the coupling assembly 80 and the annular stop wall 59. Additionally, the spring ring 88 can be introduced into the annular slot 57 so as to preclude movement of the retention ring 82 (and, in turn, the bar member) in the opposite direction. Thus, essentially, the retention ring 82 is sandwiched (with suitable washers) between the annular stop wall 59 and the spring ring 88, both of which are laterally fixed relative to the inner bore of the first sleeve member. The coupling assembly allows for relative rotative movement between the first sleeve member and the bar member, while precluding transverse relative movement between the first sleeve member and the bar member. That is, the first sleeve member is generally not readily slidable along the bar member between the first end and the second end thereof.

Once assembled, the inner slidable engagement structure 60 interfaces with the bar member about the inner bearing region 32. Similarly, the outer slidable engagement structure 70 interfaces with the bar member about the outer bearing region 36. In the configuration shown, the first surface enhanced region 34 has a compressive residual stress that is present on the surface and that extends axially inwardly at least 0.01 inches from the surface, and more preferably inwardly a distance of at least 0.025 inches, and more preferably inwardly at least 0.035 inches. In the configuration shown, the first surface enhanced region 34 extends from a point inboard of the first side sleeve region to a region that is one of into and beyond the inner bearing region, and preferably beyond the shoulder portion 46 of the first sleeve member 40. In some configurations the residual stress on the surface is greater than −50 ksi (with the negative indicating a compressive residual stress) and preferably greater than approximately −100 ksi. In some configurations, a residual stress of at least −75 ksi is exhibited at least at a depth of 0.10 inches. Interestingly, a combination of compressive residual stress at the outer surface with compressive residual stress extending axially inwardly is achieved in the surface enhanced regions. In the configuration shown, the surface enhanced region has a percentage of cold working that is less than about 3.5% and in many configurations less than about 2.0%.

Figure 10:
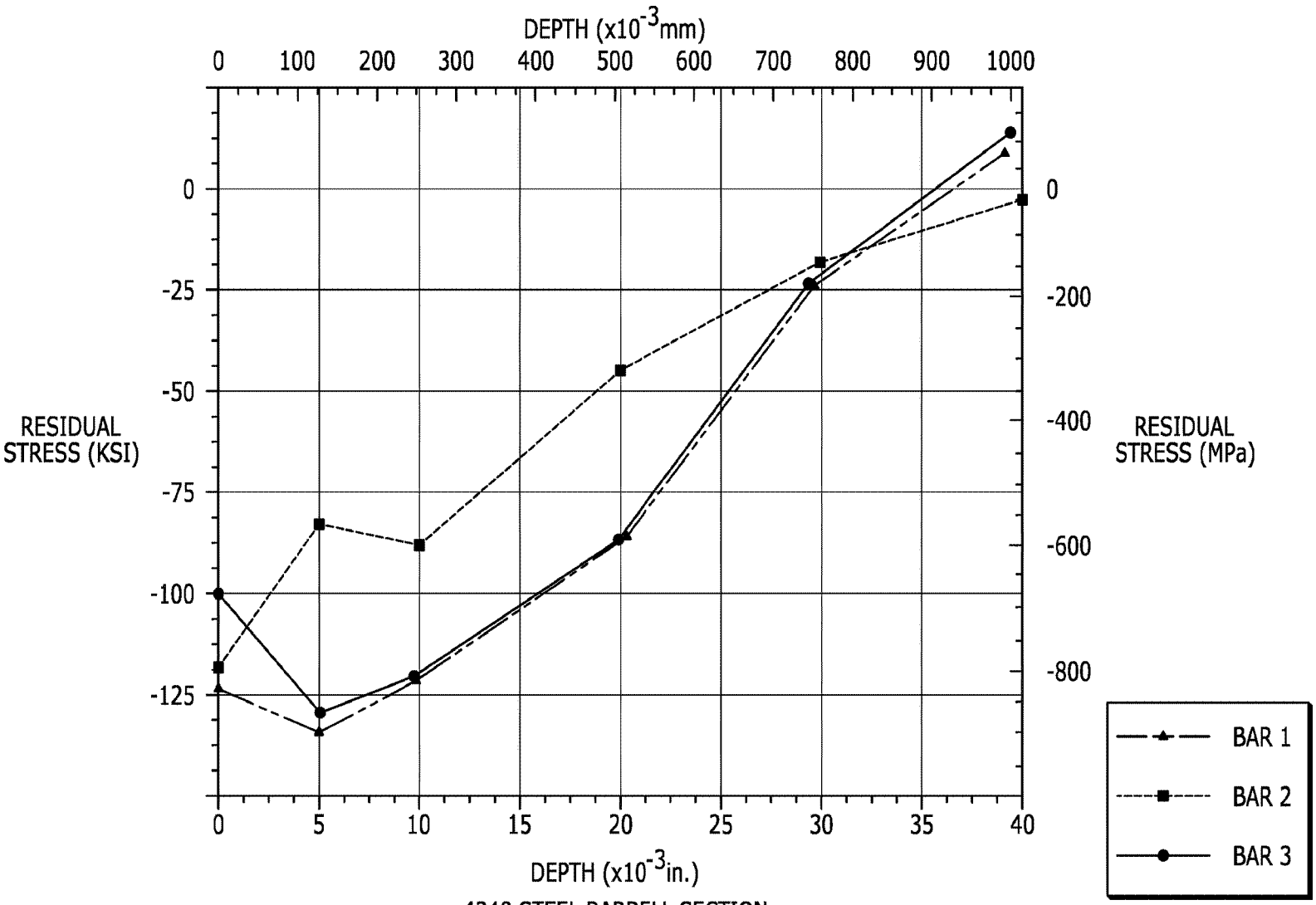
FIG. 10 of the drawings is a graph of residual stresses as a function of axial depth in three different samples of bar members prepared in accordance with the present disclosure.

With reference to FIG. 10, a test was undertaken of three bar members prepared pursuant to the present disclosure. The bar members comprised a 4340 Alloy Steel having a diameter of 1.125 inches and a length of 86.03 inches. A zone that was 2.5 inches in length was formed starting 15.68 inches from the first end and a second zone that was 2.5 inches in length was formed starting 67.86 inches from the first end. Once processed, the residual stresses were measured using x-ray diffraction in accordance with SAE HS-784. A result showing the residual stresses as a function of axial depth (that is the depth inward toward the center of the bar member from the outer surface thereof) is depicted. In the three separate test samples, the compressive residual stress of all three samples is at least approximately −100 ksi at the surface. Additionally, each of the samples exhibited a compressive residual stress that was greater than zero and greater than 0.035 inches inwardly from the outer surface of the bar member. The three samples had compressive residual stresses of approximately −25 ksi at 0.030 inches axially inwardly from the outer surface. The stresses are disclosed as negative numbers solely to indicate compressive stress.

In the configuration shown, the surface enhanced region is about 2.5 inches in length, and preferably at least 1.75 inches in length (while not limited thereto), and extends into the knurled portion of the barbell (which knurled portion is formed after the surface enhancement), in the configuration shown, 0.375 inches into the knurled portion. It is contemplated, however, that such surface enhanced regions may be shorter, that is substantially less than 1.75 inches in length, for example, as short as 0.25 inches, as well as being greater than 2.5 inches in other configurations. It will be understood that the length of the surface enhanced region is not limited to any particular length. Such a configuration may likewise extend between the central region and the first and second sleeve regions on either side, so as to capture the area that is under and inboard of, for example, a bumper plate and the shoulder portion of the first side weight assembly, capturing at least a portion of the underlying inner slidable engagement structure. In other words, at least a portion of the bar member includes a surface enhanced region extending from the first side sleeve region so as to be at least partially engageable by the inner slidable engagement structure and extending beyond the inner end of the first sleeve member into the central region. It will be understood that the slidable engagement structure (bearing or bushing) may extend beyond the surface enhanced region toward the end of the bar member. In other configurations, the entire bar member may include a surface enhanced region of the type described herein.

It is also contemplated that the surface enhanced region extends radially around the entire circumference of the bar member in the region. It is contemplated that in some configurations, the surface enhanced region may extend only partially about the circumference of the bar member and that it may comprise a plurality of discrete surface enhanced regions along the circumference of the bar member, and also along the length of the bar member, depending on the configuration and desired strength characteristics.

Problematically, it has been observed that bar members tend to break from fatigue due to dropping weights from a height after the lift is completed. It has been found that in many instances the less weights that are sequentially positioned on the weight surface of the sleeve members, the quicker the failure of the bar. It has been determined that such degradation to the bar member occurs due to the moments created about the bar member proximate the inner bearing surface due to the movement and forces between the end of the weights and the distal end of the bar member. The fewer weights that are sequentially placed, the larger the radius arm of the moment that is created. It has been found that having a surface enhanced region that extends inboard beyond the bearing surfaces to a region that is beyond the shoulder portion (and preferably beyond the width of a conventional weight that can be coupled and slid over the weight surface), can enhance the life of the bar member significantly. It has been found that such a surface enhanced region extending along the entirety of the bar member does not significantly increase the lifetime operation of the bar member, although it may be desirable to have a surface enhanced region that extends the entire length of the bar member.

One such manner of achieving the surface enhanced region is through a process such as low plasticity burnishing (LBP), such as through the LBP process offered by Lambda Technologies Group, of Cincinnati, Ohio. Among other variations of the process, processes that are covered in whole or in part by any one of U.S. Pat. Nos. 5,826,453; 6,415,486; 6,622,570; 7,549,345; 7,188,398; and/or 7,219,044 are contemplated, and, all of such patents are incorporated by reference herein in their entirety. It will be understood to one of skill in the art of such treatment processes, that the process can be applied to alter only a portion of the length of the bar member. Of course, the surface enhanced region can be formed through other processes, so the surface enhanced regions are not limited to formation through such processes.

Figure 7:
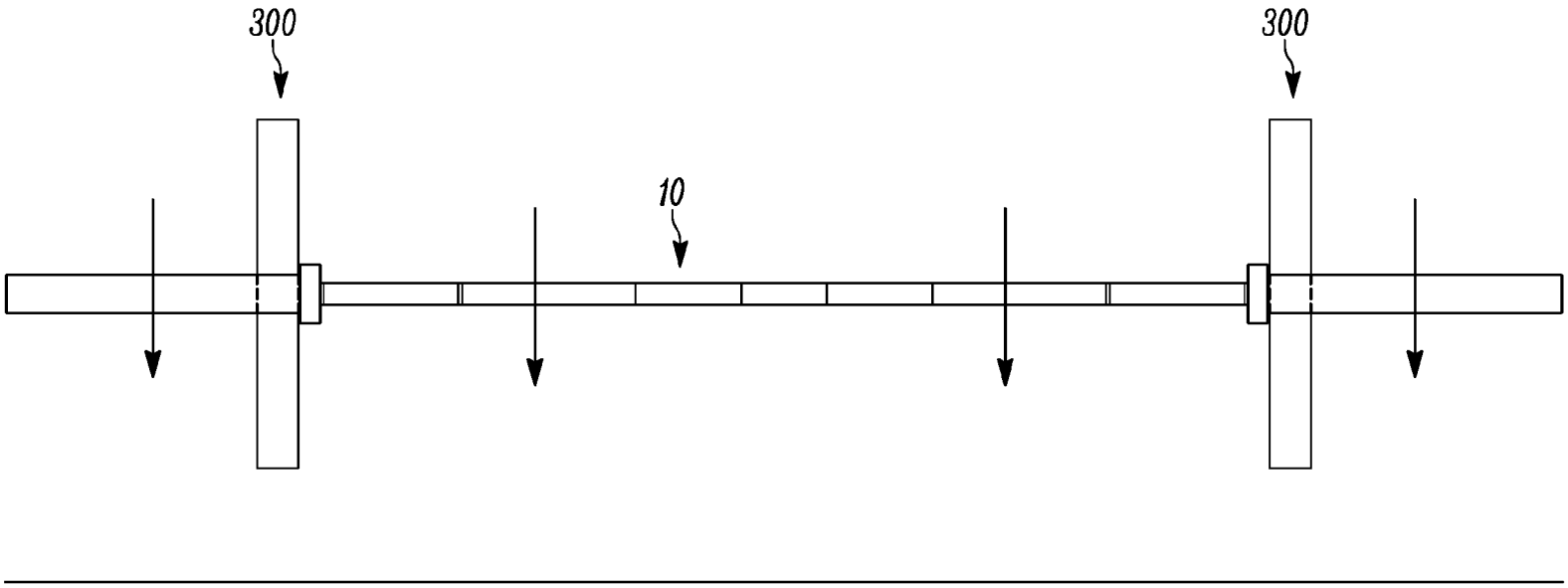
FIG. 7 of the drawings is a schematic representation of a barbell having weights on each of the first and second side weight assemblies, as the barbell is dropped onto the ground.
Figure 8:
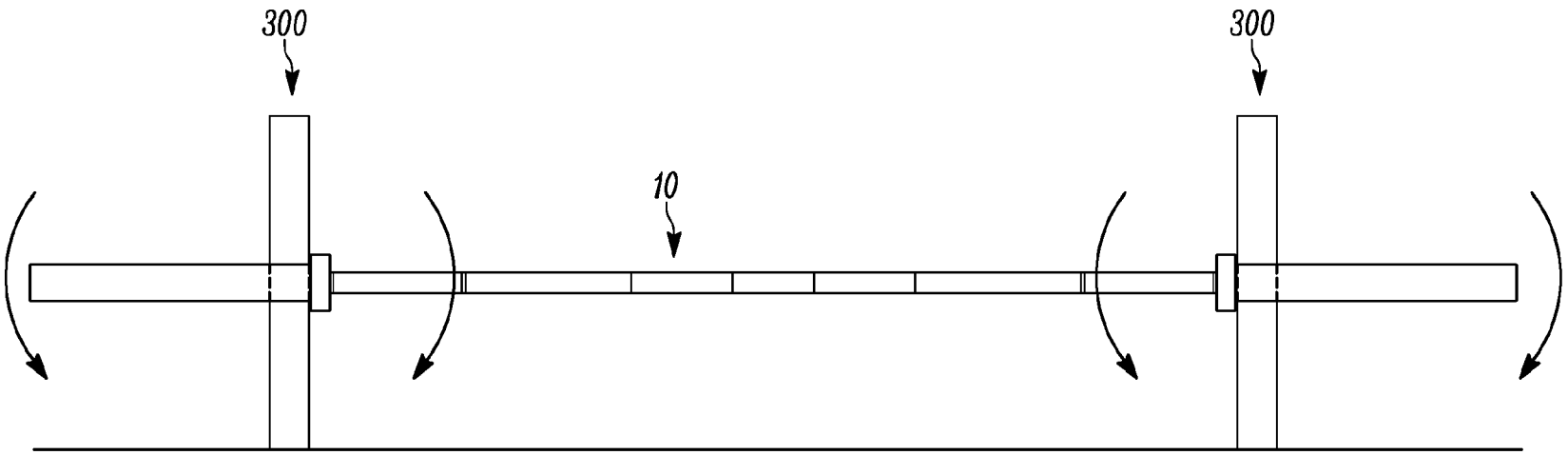
FIG. 8 of the drawings is a schematic representation of the barbell of FIG. 7 as the barbell impacts the ground, schematically showing the stresses associated therewith.

In operation, a user can stack a weight onto each sleeve of the barbell, as is shown in FIG. 7. When the weight is lifted, the bar may desirably remain substantially rigid or may flex a predetermined amount based upon the added weights. When the weights are dropped, the contact to the ground is achieved through the weight. The portion of the bar member and the weight assemblies outboard of the interface with the weight have a whip-like movement denoted by the arrows in FIG. 8. It is this repeated whip-like moment that eventually causes premature failure of the bar member, and, in turn, the barbell. Such failure is most typically proximate the inner end of the sleeve member.

Interestingly, while the cost of the bar member having the disclosed surface enhanced region is not significantly greater than that of a conventional bar member, it has been found that a 2-4× or greater lifetime can be achieved with the very same underlying bar member and weight assemblies.

Figure 9:
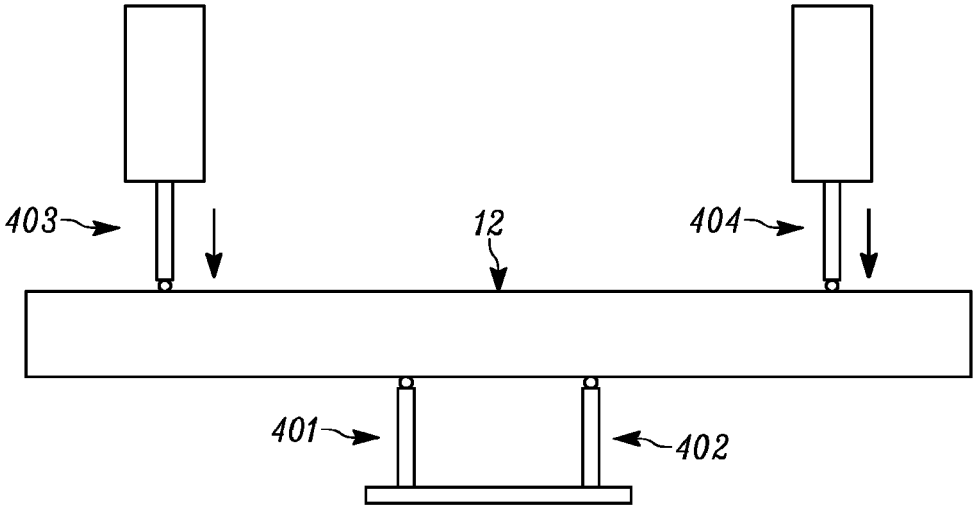
FIG. 9 of the drawings is a schematic representation of the barbell of the present disclosure undergoing a three point bending test to determine an F scale number for the barbell.

A number of tests were performed on various different bar configurations. A four point bending test was developed, as is shown in FIG. 9. In the figure shown, bars were placed and retained at two regions 401, 402 which are spaced apart from each other by 2 inches. The bars comprised sections of a bar that would typically form the bar member. A downward load was applied at 403, 404 opposite the two regions 401, 402, where the load application at 403 is spaced 7 inches from the retaining region 401 and the load application at 404 is spaced 7 inches from the retaining region 402. The downward load was cycled between a small load, to keep the bar in place, and a maximum load to create a large maximum stress. A maximum stress of 150,000 psi was chosen as the maximum load.

First a number of chromed barbells of the prior art were tested. The bars all had a tensile strength of between 190,000 and 215,000 psi. These bars all failed at approximately 25,000 cycles. This bar has therefore formed a baseline of a scale, that will be called an F scale, with 25,000 cycles forming an F1. It will be understood that, for example, an F4 would mean that the bar can withstand four times the cycles before failure. A standard bare steel or zinc plated bar of the type disclosed above, having the surface enhanced regions, as set forth above, corresponded to an F8, meaning that it can survive 120 times the cycles of the baseline bar, or 3,000,000 cycles, or beyond. In many instances this corresponds to years and years of use in a high use facility. It is advantageous to have an F scale of at least F20. Quite surprisingly, barbells made in accordance with the present disclosure have been tested and have achieved millions of cycles without failure.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A barbell comprising:

a bar member having a first end and a second end opposite the first end, and defining a central region, with a first side sleeve region on one side of the central region and a second side sleeve region on a second side of the central region opposite the first side sleeve region, and an outer surface;

a first side weight assembly including:

a first sleeve member having an inner end and an outer end, and having a weight surface and an inner bore, with the first side sleeve region of the bar member extending into the inner bore of the first sleeve member;

an inner slidable engagement assembly positioned within the inner bore between the first sleeve member and the bar member proximate the inner end of the first sleeve member, to, in turn, facilitate rotation of the first sleeve member about the bar member; and an outer slidable engagement assembly positioned within the inner bore between the first sleeve member and the bar member proximate the outer end, to, in turn, facilitate rotation of the first sleeve member about the bar member; and a second side weight assembly including:

a second sleeve member having an inner end and an outer end, and having a weight surface and an inner bore, with the second side sleeve region of the bar member extending into the inner bore of the second sleeve member;

an inner slidable engagement assembly positioned within the inner bore between the second sleeve member and the bar member proximate the inner end of the second sleeve member, to, in turn, facilitate rotation of the second sleeve member about the bar member; and an outer slidable engagement assembly positioned within the inner bore between the second sleeve member and the bar member proximate the outer end of the second sleeve member, to, in turn, facilitate rotation of the second sleeve member about the bar member;

wherein the bar member includes a first surface enhanced region positioned at a location between the first end and the central region of the bar member and extending from the first side sleeve region into the first side of the central region so as to be at least partially engageable by the inner slidable engagement assembly of the first side weight assembly, and a second surface enhanced region positioned at a location between the second end and the central region of the bar member and extending from the second side sleeve region into the second side of the central region of the bar member so as to be at least partially engageable by the inner slidable engagement assembly of the second side weight assembly and wherein the first surface enhanced region and the second surface enhanced region are spaced apart from each other along the bar member.

2. The barbell of claim 1 wherein the first and second surface enhanced regions each have compressive residual stress within the bar member directed from the outer surface towards an axis of the bar member.

3. The barbell of claim 2 wherein the compressive residual stress of each of the first and second surface enhanced regions extends from the outer surface of the bar member to 0.01 inches inwardly from the outer surface of the bar member.

4. The barbell of claim 3 wherein the compressive residual stress of each of the first and second surface enhanced regions extends from the outer surface of the bar member to 0.025 inches inwardly from the outer surface.

5. The barbell of claim 4 wherein the compressive residual stress of each of the first and second surface enhanced regions extends from the outer surface of the bar member to 0.035 inches inwardly from the outer surface of the bar member.

6. The barbell of claim 2 wherein the compressive residual stress at an outer surface of each of the first and second surface enhanced regions is 50 ksi.

7. The barbell of claim 6 wherein the compressive residual stress at the outer surface of each of the first and second surface enhanced regions is 100 ksi.

8. The barbell of claim 3 wherein each of the first and second surface enhanced regions have a length of 1.75 inches and extend about an entire circumference of the bar member along the outer surface thereof.

9. The barbell of claim 8 wherein a cold working percentage of the first and second surface enhanced regions is less than 3.5%.

10. The barbell of claim 1 wherein the inner slidable engagement assembly and the outer slidable engagement assembly of each of the first side weight assembly and the second side weight assembly comprises one of a bushing and a bearing.

11. The barbell of claim 10 wherein the one of the bushing comprises a bronze bushing and the bearing comprises a needle bearing.

12. The barbell of claim 1 wherein:

the first sleeve member further comprises a shoulder portion at the inner end of the first sleeve member, with the weight surface extending outwardly therefrom to the outer end of the first sleeve member;

the second sleeve member further comprises a shoulder portion at the inner end of the second sleeve member, with the weight surface extending outwardly therefrom to the outer end of the second sleeve member;

wherein at least a portion of the weight surface, and the entirety of the shoulder portion of the first sleeve member overlie the first surface enhanced region of the bar member; and wherein at least a portion of the weight surface, and the entirety of the shoulder portion of the second sleeve member overlie the second surface enhanced region of the bar member.

13. The barbell of claim 1 wherein the bar member includes a cross-sectional configuration that is circular, and has a diameter of between 24 mm and 30 mm.

14. The barbell of claim 1 wherein the first side weight assembly and the second side weight assembly are mirror images of each other taken about an axis bisecting the bar member.

15. The barbell of claim 1 having an F scale of F6.

16. The barbell of claim 1 having an F scale of F20.

17. A bar member structurally configured for a barbell, the bar member comprising:

an outer surface, a first end and a second end;

a central region, with a first side sleeve region being disposed to a first side of the central region and a second side sleeve region being disposed to a second side of the central region;

a portion of each of the first side sleeve region and the second side sleeve region defining an inner bearing region;

wherein a portion of the outer surface of the bar member extending between at least a portion of the inner bearing region and the central region proximate to the first side sleeve region defines a first surface enhanced region and a portion of the outer surface extending between at least a portion of the inner bearing region and the central region proximate to the second side sleeve region defines a second surface enhanced region, wherein the first surface enhanced region and the second surface enhanced region are spaced apart from each other along the bar member.

18. The bar member of claim 17 wherein a portion of the central region includes knurling, with each of the first surface enhanced region and the second surface enhanced region extending into the knurling.

19. The bar member of claim 18 wherein the bar member comprises a circular cross-sectional configuration, having a diameter of between 22 mm and 36 mm.

20. The bar member of claim 17 comprising one of a stainless steel and a steel member having a tensile strength of between 185,000 and 220,000 psi.

21. A bar member structurally configured for a barbell, the bar member comprising:

an outer surface, a first end and a second end;

a central region, with a first side sleeve region being disposed to a first side of the central region and a second side sleeve region being disposed to a second side of the central region;

a portion of each of the first side sleeve region and the second side sleeve region defining an inner bearing region;

wherein a portion of the outer surface of the bar member extending between at least a portion of the inner bearing region and the central region proximate to the first side sleeve region defines a first surface enhanced region and a portion of the outer surface extending between at least a portion of the inner bearing region and the central region proximate to the second side sleeve region defines a second surface enhanced region, wherein each of the first side sleeve region and the second side sleeve region includes an outer bearing region, wherein the outer bearing region of each of the first side sleeve region and the second side sleeve region is spaced apart from the first surface enhanced region and the second surface enhanced region, respectively.

* * * * *